United States Patent [19]

Landis et al.

[11] Patent Number: 4,873,008

[45] Date of Patent: Oct. 10, 1989

[54] JOJOBA OIL AND JOJOBA OIL DERIVATIVE LUBRICANT COMPOSITIONS

[75] Inventors: Phillip S. Landis, Alexandria, Va.; Frank Erickson, Seattle, Wash.

[73] Assignee: International Lubricants, Inc., Seattle, Wash.

[21] Appl. No.: 273,709

[22] Filed: Nov. 16, 1988

Related U.S. Application Data

[63] Continuation of Ser. No. 88,186, Aug. 21, 1987, abandoned.

[51] Int. Cl.[4] ..... C10M 141/10

[52] U.S. Cl. ..... 252/46.6; 252/49.8; 252/56 R

[58] Field of Search ..... 252/46.6, 49.8, 56 R

[56] References Cited

U.S. PATENT DOCUMENTS

| | | | |
|---|---|---|---|
| 2,298,855 | 10/1942 | Wright | 252/56 R |
| 2,450,403 | 9/1948 | Wells | 252/48.6 |
| 2,628,187 | 2/1953 | Frohmader et al. | 167/82 |
| 2,921,874 | 1/1960 | Kubie | 143/6.14 |
| 3,729,415 | 4/1973 | Davis et al. | 252/25 |
| 3,763,244 | 10/1973 | Shubkin | 260/676 R |
| 3,780,128 | 12/1973 | Shubkin | 260/683.9 |
| 3,849,323 | 11/1974 | Hollinshead | 252/56 |
| 3,850,828 | 11/1974 | Dodson et al. | 252/59 |
| 3,873,457 | 3/1975 | Magne et al. | 252/47.5 |
| 4,329,298 | 5/1982 | Brown et al. | 260/405.6 |
| 4,360,387 | 11/1982 | Brown et al. | 106/243 |
| 4,420,647 | 12/1983 | Hammond et al. | 585/10 |
| 4,557,841 | 12/1985 | Arndt | 252/32.7 |
| 4,582,617 | 4/1986 | Doner et al. | 252/52 A |
| 4,587,107 | 5/1986 | Wisniak | 252/48.6 |

FOREIGN PATENT DOCUMENTS 3327127 7/1984 Fed. Rep. of Germany .

OTHER PUBLICATIONS

Estefan, "Jojoba as a Possible Lubricant", American Oil Chemists Society Meeting Presentation, (1983).

Miwa et al., "Extreme Pressure Lubricant Tests on Jojoba and Sperm Whale Oils," *J. Am. Oil Chemists Soc.*, 56:765 70, (1979).

Gisser et al., "Jojoba Oil as a Sperm Oil Substitute", *Wear*, 34:53–63, (1975).

Wolff, "Seed Lipids," *Science*, 154:1140–49, (1966).

Schwab et al., "Configuration of Octaderyl Tetrasulfide," *Phosphorus and Sulfur*, 10:123–26, (1981), [Schawb et al., I].

Princen et al., "Development of New Crops for Industrial Raw Materials," *JAOCS*, 61:281–89, (1984).

Schwab et al., "Hydrogen Sulfide Adducts of Methyl trans, trans-9,11-Octacecadienoate," *J. Am. Oil Chemists' Soc.*, 55:860–64, (1978), [Schwab et al. III].

Schwab et al., "Nucleophillic Addition of Hydrogen Sulfide to Methyl Oleate, Methyl Linoleate, and Soybean Oil," *J. Am. Oil Chemists' Soc.*, 52:236–239, (1975), [Schwab et al. II].

Kammann et al., "Sulfurized Vegetable Oil Products as Lubricant Additives," *JAOCS*, 62: (1985).

*Primary Examiner*—William R. Dixon, Jr.
*Assistant Examiner*—Jerry D. Johnson
*Attorney, Agent, or Firm*—Seed and Berry

[57] ABSTRACT

There is disclosed an improved lubricant base composition for incorporation into a wide variety of lubricating compositions. The improved lubricant base composition comprises at least two ingredients selected from jojoba oil, sulfurized jojoba oil, and a phosphite adduct of jojoba oil.

12 Claims, No Drawings

JOJOBA OIL AND JOJOBA OIL DERIVATIVE LUBRICANT COMPOSITIONS

This application is a continuation of U.S. patent application Ser. No. 088,186, filed Aug. 21, 1987, now abandoned under C.F.R. § 1.62.

DESCRIPTION

1. Technical Field

The present invention relates to a lubricant base composition and lubricant compositions with antifriction properties that contain jojoba oil and jojoba oil derivatives as the active lubricating agents. More specifically, this invention relates to a composition of jojoba oil and a phosphite adduct of jojoba oil and/or a sulfurized jojoba oil that is used in combination to form the active lubricating agents.

2. Background Art

Jojoba oil is a natural mixture of straight-chain, unsaturated, monocarboxylic acid esters comprising primarily $C_{18}$ to $C_{24}$ monounsaturated alcohols esterified with $C_{18}$ to $C_{24}$ monounsaturated acids. The double bond is located predominantly in the $C_9$ position in both the alcohol and acid portion of the esters. Jojoba oil is conventionally cold-pressed from the seed of *Simmondsia chinensis,* a desert shrub native to California, Arizona, and Mexico.

Jojoba oil and many of its derivatives have been disclosed in the literature. Jojoba oil has been used primarily in cosmetics and hair shampoos, but has also been disclosed as useful as a lubricant. Arndt, U.S. Pat. No. 4,557,841, refers to jojoba oil as a lubricating additive and useful in the range of 0.1% to 10% (w/w) in a motor oil with a standard motor oil formulation. Kuble, U.S. Pat. No. 2,921,874, refers to the use of jojoba oil as a cold forming lubricant for use in cold extrusion of metals. Further, Brown et al., U.S. Pat. No. 4,360,387, refer to the use of isomorphous compositions of trans-isomerates of jojoba oil as useful as food machinery lubricants. Hollinshead, U.S. Pat. No. 3,849,323, refers to blended petroleum products for lubrication containing a natural oil, such as jojoba oil.

There is a largely unfulfilled need for new and improved lubricants and lubricant additive systems to improve the friction properties of lubricants, such as cutting fluids, precoat oils, metal-working oils, automatic transmission fluids (ATFs), gear oils, way oils, and automotive and marine oils. Various jojoba oil derivatives alone have been suggested as lubricating oil compositions. For exampler, German Pat. No. 3,309,211 refers to the reaction of jojoba oil with $P_2S_5$ at high temperature and under a nitrogen atmosphere. German Pat. No. 3,327,127 refers to the use of jojoba oil in a sulfochlorinated mixture to improve anticorrosion or antiwear properties. Miwa et al. ("Extreme-Pressure Lubricant Tests on Jojoba and Sperm Whale Oils," *J. Amer. Oil Chemists' Soc.* 56: 765–70, 1979) refers to lubricant tests on sulfurized jojoba oil as an extreme-pressure additive for motor oils, gear lubricants, and automotive transmission fluids. Miwa et al. found that the sulfurized jojoba oil as an antiwear additive for lubricants was at least equivalent to, and in some cases superior to, sulfurized sperm oil.

The use of jojoba oil as a lubricating derivative or agent in the prior art has been confined to single-agent use, i.e, jojoba oil and sulfurized derivatives of jojoba oil have been used individually as single agents in the art. There remains, however, much room for improvement of lubricating properties for automotive and marine oils, cutting fluids, precoat oils, metal-working oils, ATFs, gear oils, and way lubricants. The present invention represents novel compositions which are superior to prior art lubricants for use in many well-known applications.

DISCLOSURE OF THE INVENTION

The present invention provides a lubricant base and lubricating compositions containing a mixture of at least two of the following three compounds, jojoba oil, sulfurized jojoba oil, and a phosphite adduct of jojoba oil. The compositions of the present invention provide superior lubricating characteristics, having antifriction characteristics and antiwear and load-carrying properties that are superior to any one compound alone. Improved antifriction characteristics may result in reduced fuel consumption for internal-combustion engines and lowered operating temperatures when used in engines and other industrial machinery. Further, the present invention provides for cutting fluids, precoat oils, metal-working oils, ATFs, gear oils, way lubricants, greases, aviation oils, textile lubricants, hydraulic oils, circulating oils, steam cylinder oils, spindle oils, fire-resistant fluids, and automotive and marine oils that incorporate the inventive lubricant base as the active lubricating agent.

BEST MODE FOR CARRYING OUT THE INVENTION

As noted above, the present invention comprises a lubricant base and a lubricating composition with antifriction properties, including antiwear and load-carrying properties, consisting of a lubricant base and a base fluid. The lubricant base comprises a mixture of two or three of the ingredients selected from the group consisting of jojoba oil, a phosphite adduct of jojoba oil, and sulfurized jojoba oil. The amounts of ingredients used in the compositions of this invention are based upon the final lubricating composition. The lubricating base can comprise about 0.1% to about 20% (w/w) jojoba oil and about 0.1% to about 5% (w/w) sulfurized jojoba oil. Alternatively, the lubricant base can comprise about 0.1% to about 20% (w/w) jojoba oil, about 0.1% to about 5% (w/w) sulfurized jojoba oil, and about 0.1% to about 5% (w/w) of a phosphite adduct of jojoba oil. Another lubricant base combination can comprise about 0.1% to about 20% (w/w) jojoba oil and about 0.1% to about 5% (w/w) of a phosphite adduct of jojoba oil. The lubricant base must contain a mixture of at least two of the three ingredients selected from the group consisting of jojoba oil, a phosphite adduct of jojoba oil, and a sulfurized jojoba oil, and possibly all three of these ingredients.

The lubricant base is mixed with a base fluid to make a lubricating composition with antifriction properties, including antiwear and load-carrying properties. Examples of lubricating compositions include cutting fluids, precoat oils, metal-working oils, ATFs, gear oils, way lubricants, greases, aviation oils, textile lubricants, hydraulic oils, circulating oils, steam cylinder oils, spindle oils, fire-resistant fluids, and automotive and marine oils. Examples of base fluids include hydrocarbon oil; synthetic hydrocarbon; an ester-based lubricant; a mineral oil; a mixture of a mineral oil and an ester-based lubricant; a mixture of mineral oil, synthetic hydrocarbon, and an ester-based lubricant; a mineral oil-based grease; and a synthetic hydrocarbon-based grease. Specifically, the base fluids are:

a. mineral oils, such as paraffinic neutral 100", furfural-refined paraffinic oil, solvent-refined napthenic oil, and solvent-refined aromatic oil;

b. synthetic hydrocarbon oils, such as hydrogenated or partially hydrogenated polydecene and other olefins, hydrogenated hexene oligomer, hydrogenated octene oligomer, hydrogenated decene oligomer, hydrogenated $C_{6-10}$ oligomer, and hydrogenated $C_{8-10}$ oligomer;

c. ester fluids, such as pentaerythritol esters having the structures:

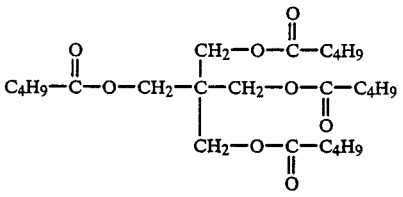

and

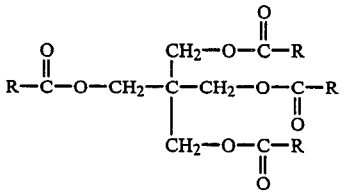

wherein R is $C_4H_9$, $C_6H_{13}$, $C_8H_{17}$, or mixtures thereof, esters of trimethylolpropane and dipentaerythritol of the structures:

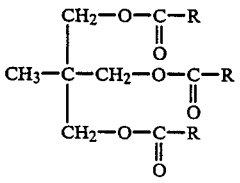

and

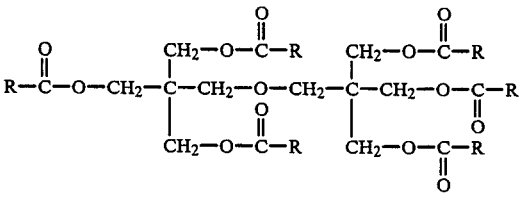

wherein R is as defined as above, di-2-ethylhexyladipate, di-2-ethylhexylsebacate, didecyladipate, and didecylsebacate;

d. dialkylbenzenes, such as didocecylbenzene;

e. polyglycols, such as UCON fluids, polypropyleneglycols of 1000 to 3000 molecular weight and polyethyleneglycols of 1000 to 3000 molecular weight;

f. alkylaromatics; and g. dicarboxylic acids.

Jojoba oil has the following structural formula:

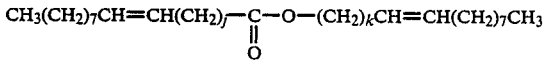

wherein j=7, 9, 11 or 13 k=6, 8, 10 or 12

While other sulfurized jojoba oils may be used in the present invention, a preferred sulfurized jojoba oil is the product of a reaction of jojoba oil and 10% to 20% sulfur to yield the following:

n=1–3

A—$S_n$—A and

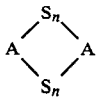

and mixtures of both wherein A refers to the structure of jojoba oil.

While other phosphite adducts of jojoba oil may be used in the present invention, a preferred phosphite adduct of jojoba oil is formed by the reaction of jojoba oil and a compound of the formula:

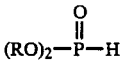

wherein R=H, $C_{1-12}$ alkyl, $C_{1-12}$ aryl, $C_{1-12}$ alkaryl, $C_{1-12}$ aralkyl, and cyclo $C_{1-12}$ alkyl. Preferably, R=$C_{4-8}$ alkyl, $C_{4-8}$ alkaryl, $C_{4-8}$ aralkyl, and cyclo $C_{4-8}$ alkyl. Most preferably, R is n-butyl.

As may be seen from its structural formula, jojoba oil has two carbon-carbon double bonds. Accordingly, the phosphite adduct can be a diadduct or a monoadduct of the jojoba oil. There are thus four examples of the phosphite adduct of jojoba oil are when R is butyl as follows:

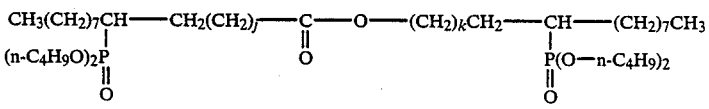

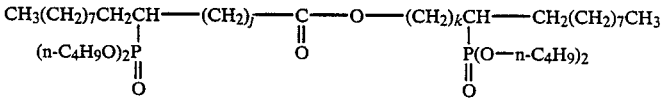

-continued

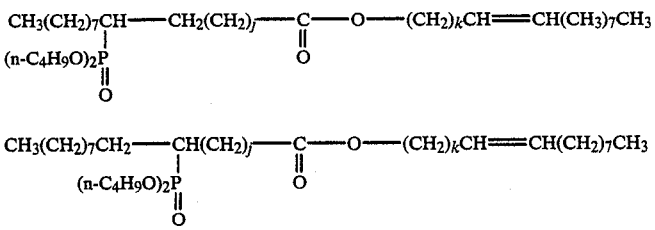

wherein j and k are defined as above.

The present invention is further illustrated by the following examples which following examples are offered as an illustration and not a limitation of the present invention.

Examples of the lubricant base and lubricating compositions are provided in the Tables 1 and 2. The attached tables also provide performance results from standard tests, including low-velocity friction apparatus, the 4-ball wear test, and the Falex test. The procedures for each test are as follows.

4-BALL TESTS FOR ASSESSING EXTREME-PRESSURE PROPERTIES

The measurement of friction as related to rolling, drawing, and other metal-working operations depends upon the surface of the tool and workpiece and the viscosity and chemical makeup of the lubricant, as well as the pressure and temperature developed during processing. The 4-ball wear test machine provides, under controlled testing conditions, a procedure for measuring friction. The machine consists of three balls touching each other and clamped together in a horizontal plane. A fourth ball touches three clamped balls by being positioned between the three and is driven by a motor so that it revolves in contact with the clamped balls. The rotation takes place within a reservoir containing a test lubricant. A temperature-measuring device, as well as a heater, provides a method for controlling the temperature of the test fluid. The rotating ball is loaded and then rotated for a specific time at a specific speed. At the conclusion of the test, the scar patterns developed on the balls are measured. Any stains are observed, the diameter of the scar is measured, and the coefficient of friction is calculated by dividing the tangential force by the normal force at the ball surface.

LOW-VELOCITY FRICTION APPARATUS

The low-velocity friction apparatus (LVFA) is used to measure the friction of test lubricants under various loads, temperatures, and sliding speeds. The LVFA consists of a flat steel surface (diameter 1.5 inches) which is attached to a drive shaft and rotated over a stationary, raised, narrow ringed steel surface (area 0.08 inch$^2$). Both surfaces are submerged in the test lubricant. Friction between the steel surfaces is measured as a function of the sliding speed at a lubricant temperature of 250° F. The friction between the rubbing surfaces is measured using a torque arm/strain gauge system. The strain gauge output, which is calibrated to be equal to the coefficient of friction, is fed to the Y-axis of an X-Y plotter. The speed signal from the tachometer-generator is fed to the X-axis.

FALEX TEST

The Falex test consists of a method for measuring the torque and friction developed during rotation of a pin between two stationary V blocks. The pin as well as the V blocks can be made of various materials. The temperature of the lubricant bath into which the pin and V block are placed may also be varied. The load is applied by a ratchet arrangement. Wear measurements made above the transition pressure, that is, the load at which the lubricant film breaks down, can be a useful parameter if carried out under conditions comparable to actual operations.

The following Tables 1 and 2 illustrate base fluids, jojoba oil in base fluids, jojoba oil with a dibutyl phosphite adduct plus base fluid, a jojoba oil plus dibutyl phosphite adduct and sulfurized jojoba oil plus base fluid for the LVFA test, the Falex wear test, and the 4-ball wear test. The two tables illustrate the improved lubricating properties of the compositions of the present invention.

TABLE 1

| Compound | Wt. % | LVFA, % Reduction in Coefficient of Friction: Sliding Speed 5 ft./min. | Sliding Speed 5 ft./min. |
|---|---|---|---|
| Base Fluid* | 100.0 | 0 | 0 |
| Jojoba Oil | 2.0 | 2 | 2 |
| Base Fluid | 98.0 | | |
| Jojoba Oil | 10.0 | 8 | 12 |
| Base Fluid | 90.0 | | |
| Jojoba Oil | 1.0 | 21 | 20 |
| Di-n-butylphosphite Adduct | 4.0 | | |
| Base Fluid | 95.0 | | |
| Jojoba Oil | 5.0 | 24 | 28 |
| Di-n-butylphosphite Adduct | 2.0 | | |
| Base Fluid | 93.0 | | |
| Jojoba Oil | 5.0 | 15 | 19 |
| Di-n-butylphosphite Adduct | 2.0 | | |
| Sulfurized Jojoba Oil | 1.0 | | |
| Base Fluid | 92.0 | | |

*Base Fluid is 100" Paraffinic Neutral Mineral Oil

TABLE 2

| | 4-Ball Wear Test Results: Wear Scar Diameter | Weld Load | Falex Test Lbs. to Fail |
|---|---|---|---|
| Base Fluid | 0.94 | 120 | 750 |
| Base Fluid + 1% Jojoba | 0.78 | 160 | — |
| Base Fluid + 5% Jojoba | 0.72 | 180 | — |
| Base Fluid + 2% Jojoba + 5% Sulfurized Jojoba | 0.52 | 240 | 4500 |
| Base Fluid + 2% Jojoba + 0.5% Phosphite Adduct | 0.52 | 220 | 4500 |
| Base Fluid + 1% Jojoba + 2% Sulfurized Jojoba + 0.5% Phosphite Adduct | 0.45 | 280 | 4900 |

The lubricant base may be added to different base fluids to obtain a composition having a variety of end-use applications. Examples of end-use applications with different base fluids are listed in Table 3.

TABLE 3

| Application | Base Fluid | Viscosity SUS @ 100° F. |
|---|---|---|
| Auto Engine Oil | Mineral Oil and/or Ester Fluid and/or Synthetic Hydrocarbon Oils | 100–200 |
| Metal-Working Lubricant | Mineral Oils | 100–200 |
| Gear Lubricant | Mineral Oils | 300–3000 |
| Textile Lubricant | Polyethyleneglycols Polypropyleneglycols | |
| Aviation Oils | Pentaerythritol Esters and Trimethylolpropane Esters | 100–150 |
| Grease | Mineral Oil Synthetic Hydrocarbons | 1000–2000 |
| Hydraulic Oils | Mineral Oils Synthetic Hydrocarbons | 100–300 |
| Circulating Oils | Mineral Oils Synthetic Hydrocarbons | 900–3000 |
| Gas Engine Oils | Mineral Oils Synthetic Hydrocarbons | 350–600 |
| Diesel Engine Oils | Mineral Oils, Esters and Synthetic Hydrocarbons | 600–1000 |
| ATFs | Mineral Oils Synthetic Hydrocarbons | 140–300 |
| Way Lubricants | Mineral Oils Synthetic Hydrocarbons | 150–1000 |
| Steam Cylinder Oils | Mineral Oils | 1800–1900 |
| Fire-Resistant Fluids | Mineral Oil (Water) | 400–500 |
| Spindle Oils | Mineral Oils | 50–130 |

The principles, preferred embodiments and modes of operation of the invention have been described in the foregoing specification. The invention which is intended to be protected herein, however, is not to be constrained as limited to the particular forms disclosed, since these are to be regarded as illustrative rather than restrictive. Variations and changes may be made by those skilled in this art without departing from the spirit of the invention.

We claim:

1. A lubricant base concentrate comprising a base oil and a mixture of about 0.1% to about 20% (w/w) jojoba oil, about 0.1% to about 5% (w/w) of a sulfurized jojoba oil, and about 0.1% to about 5% (w/w) of a phosphite adduct of jojoba oil.

2. The lubricant base according to claim 1 wherein the phosphite adduct of jojoba oil is a mono- or a diadduct of the reaction product of $$(RO)_2-\overset{\overset{\displaystyle O}{\|}}{P}-H$$

and jojoba oil, wherein R is selected from the group consisting of hydrogen, $C_{1-12}$ alkyl, $C_{1-12}$ aryl, $C_{1-12}$ alkaryl, $C_{1-12}$ aralkyl, and cyclo $C_{1-12}$ alkyl.

3. The lubricant base concentrate according to claim 2 wherein R is butyl.

4. The lubricant base concentrate according to claim 2 wherein the point of attachment of the phosphite adduct on the jojoba oil moiety is at a carbon-carbon double bond.

5. The lubricant base concentrate according to claim 1 wherein the sulfurized jojoba oil is selected from the group consisting of:

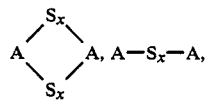

and combinations of both, wherein x is 1 to 3 and A is jojoba oil.

6. A lubricating composition with antifriction properties comprising a base fluid and a lubricant base concentrate comprising a mixture of about 0.1% to about 20% (w/w) jojoba oil, about 0.1% to about 5% (w/w) of a sulfurized jojoba oil, and about 0.1% to about 5% (w/w) of a phosphite adduct of jojoba oil.

7. The lubricating composition according to claim 6 wherein the base fluid is selected from the group consisting of a hydrocarbon oil, a synthetic hydrocarbon oil, an ester-based lubricant, a mineral oil, a mixture of a mineral oil and an ester-based lubricant, a mixture of mineral oil, synthetic hydrocarbon oil and ester-based lubricant, a mineral oil-based grease, and a synthetic hydrocarbon-based grease.

8. The lubricating composition according to claim 6 wherein the phosphite adduct of jojoba oil is a mono- or a di-adduct of the reaction product of:

$$(RO)_2-\overset{\overset{\displaystyle O}{\|}}{P}-H$$

and jojoba oil, wherein R is selected from the group consisting of hydrogen, $C_{1-12}$ alkyl, $C_{1-12}$ aryl, $C_{1-12}$ alkaryl, $C_{1-12}$ aralkyl, and cyclo $C_{1-12}$ alkyl.

9. The lubricating composition according to claim 8 wherein R is selected from the group consisting of $C_{4-8}$ alkyl, $C_{4-8}$ alkaryl, $C_{4-8}$ aralkyl, and cyclo $C_{4-8}$ alkaryl.

10. The lubricating composition according to claim 9 wherein R is butyl.

11. The lubricating composition according to claim 8 wherein the point of attachment of the phosphite adduct moiety on the jojoba oil moiety is at a carbon-carbon double bond.

12. An improved base fluid of the type normally used as a gasoline engine oil, a pre-coat oil, a gear lubricant, a textile lubricant, an aviation oil, a grease, a hydraulic oil, a circulating oil, a diesel engine oil, an automatic transmission fluid, a way lubricant, a steam cylinder oil, a marine oil, a metal-working oil, and a spindle oil, wherein the improvement comprises:

incorporating a lubricating base concentrate comprising a mixture of at least three ingredients selected from the group consisting of jojoba oil, phosphite adduct of jojoba oil, and a sulfurized jojoba oil into said base fluid.

* * * * *